US010836529B1

(12) United States Patent
Donohoe et al.

(10) Patent No.: US 10,836,529 B1
(45) Date of Patent: Nov. 17, 2020

(54) AUTOMATED HARD DRIVE STATIC-SHIELDING BAG OPENING AND REMOVAL

(71) Applicant: Google LLC, Mountain View, CA (US)

(72) Inventors: Rachel Donohoe, Seattle, WA (US); Ryan Williams, Redmond, WA (US); David Kyle Funnell, Seattle, WA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/682,180

(22) Filed: Nov. 13, 2019

(51) Int. Cl.
*B65B 69/00* (2006.01)

(52) U.S. Cl.
CPC ..... *B65B 69/0008* (2013.01); *B65B 69/0091* (2013.01)

(58) Field of Classification Search
CPC ..... B65B 69/0008; B65B 69/0091; B65B 69/0033
USPC ..... 414/412
See application file for complete search history.

(56) References Cited

U.S. PATENT DOCUMENTS

| | | | | |
|---|---|---|---|---|
| 5,375,961 | A * | 12/1994 | Mojden | B65B 69/00 414/412 |
| 5,442,895 | A * | 8/1995 | Linson | B65B 69/0008 414/412 |
| 6,431,813 | B2 * | 8/2002 | Sugaya | B65B 69/0058 414/403 |
| 7,017,751 | B2 | 3/2006 | Clark et al. | |
| 7,024,835 | B2 | 4/2006 | Payne et al. | |
| 9,272,839 | B2 | 3/2016 | Shi | |
| 10,023,343 | B2 * | 7/2018 | Aya | B65B 69/0008 |
| 10,232,600 | B2 | 3/2019 | Wang et al. | |
| 10,266,295 | B1 | 4/2019 | Kelly | |
| 10,363,635 | B2 | 7/2019 | Claretti et al. | |
| 2018/0361047 | A1 | 12/2018 | Gillespie et al. | |

* cited by examiner

*Primary Examiner* — Kaitlin S Joerger
(74) *Attorney, Agent, or Firm* — Lerner, David, Littenberg, Krumholz & Mentlik, LLP

(57) ABSTRACT

A de-bagging system includes a robot system with a robotic arm, a cutting nest assembly having a compartment including a first side-wall, and a second side-wall, and configured to receive a bagged item, a bag gripper movable relative to the first side-wall and the second side-wall, and a cutting assembly having a cutting blade. The cutting blade is slidably mounted in vicinity of the compartment. The robot system is configured to pick up a bagged item, to deposit the bagged item into the compartment, and to pick up an unbagged item from the compartment.

20 Claims, 11 Drawing Sheets

AUTOMATED HARD DRIVE STATIC-SHIELDING BAG OPENING AND REMOVAL

BACKGROUND

Hard drives are typically wrapped in static-shielding bags for protection from static charges during transportation and handling. When the hard drives arrive at a facility, each individual hard drive has to be removed from its static-shielding bag prior to installation. However, the static-shielding bags are typically tightly wrapped around the hard drives making them difficult to remove.

BRIEF SUMMARY

One aspect of the disclosure provides a de-bagging system. The de-bagging system includes a robot system with a robotic arm, a cutting nest assembly comprising a compartment, the compartment configured to receive a bagged item, a bag gripper movable relative to the first side-wall and the second side-wall, and a cutting assembly comprising a cutting blade, the cutting assembly slidably mounted in vicinity of the compartment. The robot system is configured to pick up a bagged item, to deposit the bagged item into the compartment, and to pick up an unbagged item from the compartment.

In some instances, the de-bagging system further includes a frame, a base attached to a first end of the frame and configured to support the frame. A mounting plate is mounted to a second end of the frame.

In some instances, the de-bagging system includes a rail mounted to the mounting plate such that the carriage is slidably mounted to the rail. The cutting nest assembly is rotatably mounted to the mounting plate. The bag gripper is movably mounted on the cutting nest assembly.

In some instances, the de-bagging system further includes a first sensor arranged in the cutting nest assembly and configured to detect presence of a bag in the compartment.

In some instances, the de-bagging system further includes a second sensor arranged on the robotic arm and configured to detect presence of a bag on the item.

In some instances, the compartment includes a first side-wall and a second side-wall, wherein at least one of the first and second side-walls is movable. In yet other instance, the compartment includes a movable bottom.

According to an aspect of the disclosure, a method includes depositing, using a robot system with a robotic arm, a bagged item into a compartment, gripping, using a bag gripper, an end of the bag of the bagged item, while the bagged item is accommodated in the compartment, cutting, using a cutting assembly movable mounted in vicinity of the compartment, an end of the bag, and removing, using the robot system, the item from the bag.

In some instances, the method further includes piercing the bag to remove air from the bag and/or moving a side-wall of the compartment to exert pressure on the bag. In yet another instance, the method includes moving a movable bottom of the compartment to receive the bagged item into the compartment and/or moving a movable bottom of the compartment to push an item out of the compartment. In some instances, the method further includes rotating the compartment to remove the bag.

DETAILED DESCRIPTION

The technology relates generally to an automated system for opening and removal of hard drive static-shielding bags. One example includes an automatic de-bagging system including a 6-axis robotic system or a 6-axis industrial robot or a 6-axis robot with a tool at an end of a robotic arm, which may pick up a bagged item, such as a hard drive enveloped in a static-shielding bag, and deposit the same in a de-bagging nest. The automatic system may further include a bag gripper associated with de-bagging nest and a cutter assembly arranged in the vicinity of the de-bagging nest. When a bagged item is deposited in the de-bagging nest, the bag gripper may grip a portion of the static-shielding bag and that cutter assembly may cut open the bag. The robotic arm may then pick up the item from the open bag and remove the same from the de-bagging nest and the empty bag may be discarded.

By automating the hard drive static-shielding bag removal, the manual labor and the time required for the same may be reduced. While the following description refers to removing static-shielding bags from hard drives, the described de-bagging system may be used to de-bag any other electronic or sensitive component from a static-shielding bag.

Figure 1:
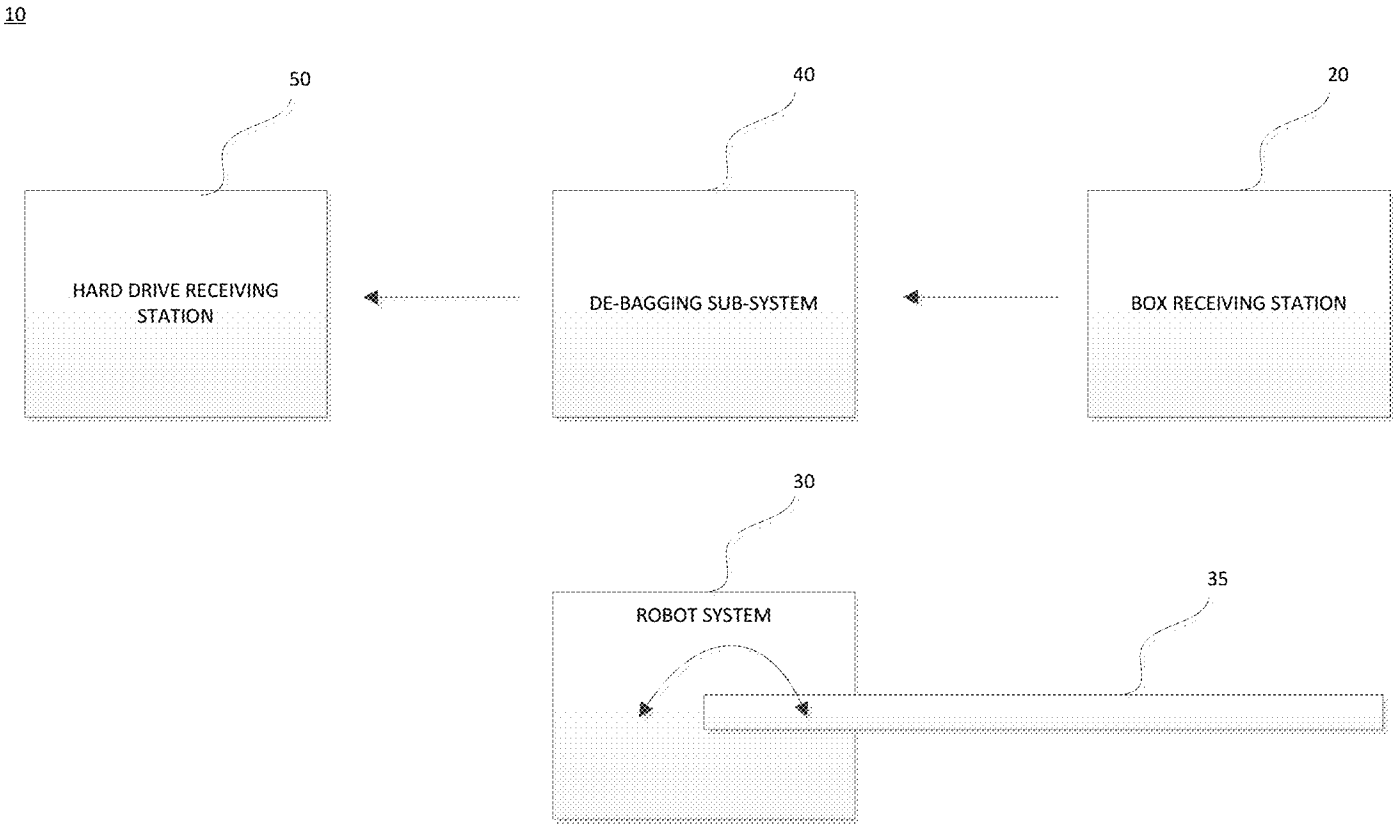
FIG. 1 illustrates an example of a system for automated hard drive static-shielding bag opening and removal.

FIG. 1 illustrates a system 10 for automated hard drive static-shielding bag opening and removal. The system 10 includes a box receiving station 20, a robot system 30, a de-bagging sub-system 40, and hard drive receiving station 50. The box receiving station 20 may receive a box filled with hard drives encased in static-shielding bags. The box receiving station 20 may include a de-lidding system for opening the box filled with hard drives and, in some instances, removing packaging materials to expose the hard drives. In some instances, the box receiving station 20 may receive an opened box filled with hard drives.

The robot system 30 may include an industrial 6-axis robot or a linear gantry system having a robotic arm 35. The robotic arm 35 may be configured to pick up one of the bagged hard drives from the box in the opened box receiving station and deposit the same in a de-bagging nest of the de-bagging sub-system 40. As described in further detail herein, the de-bagging sub-system 40 may open and remove the static-shielding bag from a hard drive. Once the static-shield bag has been removed by the de-bagging sub-system 40, the robotic arm 35 of the robot system 30 may pick the de-bagged hard drive from the de-bagging nest and deposit the same into the hard drive receiving station 50. In some instances, the robot system 30 may include more than one robotic arms, such as a robotic arm for depositing a hard drive having a static bag into the de-bagging sub system 40 and another robotic arm for removing the hard drive after the static-shield bag has been removed. In some instances, the robot may have fewer or more than 6-axis. In some instances, the robot system may be replaced with a 2 or 3 axis gantry system.

Figure 2:
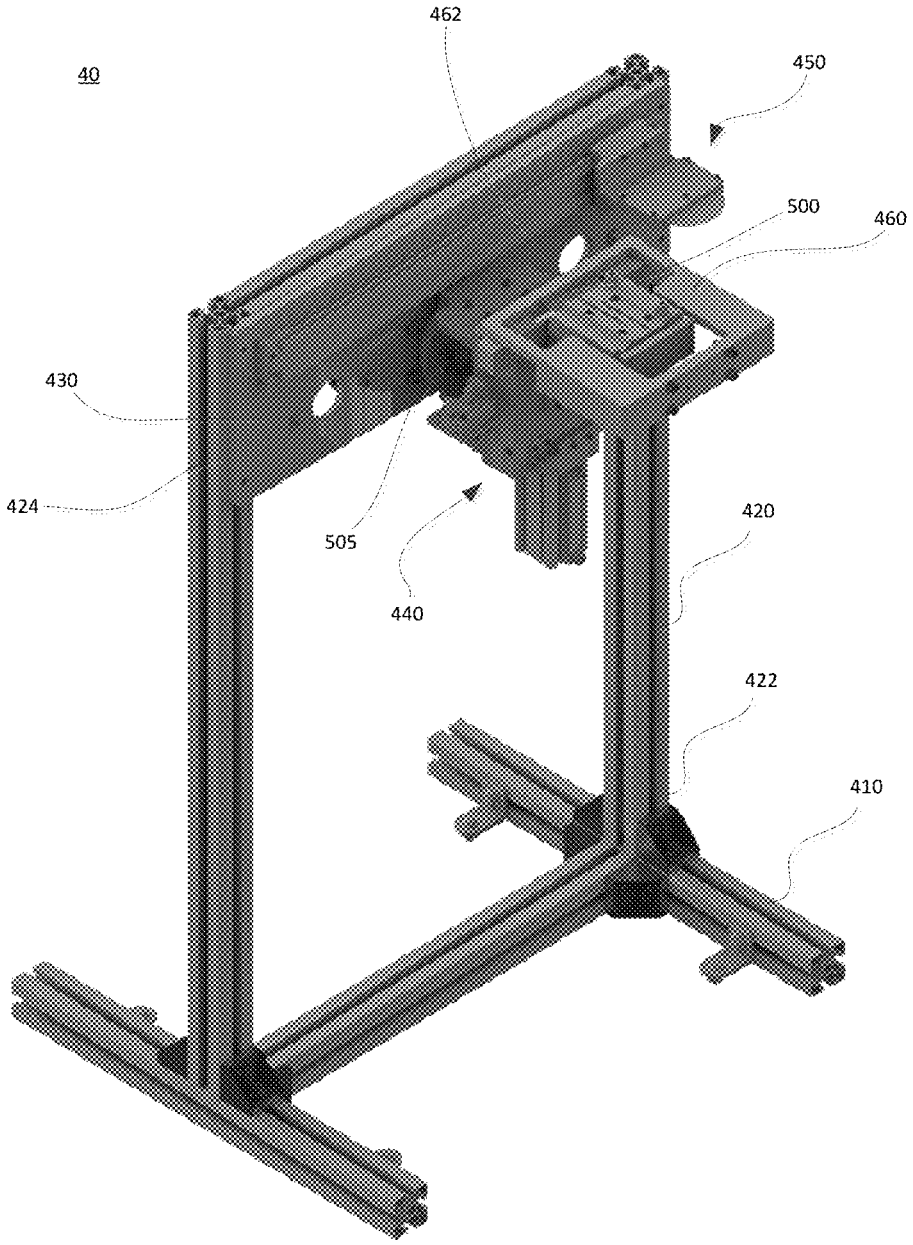
FIG. 2 shows a perspective view of a sub-system for automated hard drive static-shielding bag opening and removal of the system of FIG. 1.

FIG. 2 illustrates an example of the de-bagging sub-system 40 for opening and removing static-shielding bags from hard drives. The de-bagging sub-system 40 includes a base 410, a frame 420, a mounting plate 430, a de-bagging nest assembly 440, cutting assembly 450, and bag gripper 460.

The base 410 serves to support and position the other components of the de-bagging sub-system 40, such as the de-bagging nest assembly 440 and cutting assembly 450. In one example, the de-bagging sub-system 40 may be stationary. In this regard, the base may rest on a ground surface or be bolted or otherwise attached to a surface. In some instances, the base 410 may be moveable. In this regard, the base 410 may have casters, wheels, rollers, etc., attached to enable the base to roll or otherwise move across a surface.

The frame 420 illustrated in FIG. 2 is a rectangular frame. It will be understood that the frame 420 may have other geometric shapes, such as circular, square, and oval, by way of non-limiting examples. The frame 420 is coupled at a first end 422 to the base 410. The frame 420 may be rigidly connected at the first end 422 to the base 410, such that movement between the frame 420 and the base 410 is limited or prohibited. In other examples, the frame 420 may be movable relative to the base 410. In this regard, the frame 420 may include rollers, wheels, casters, or other such components which allow for movement, mounted to the first end 422. The rollers may attach or otherwise rest on the base 410 and allow the frame 420 to slide or otherwise move along the base.

The frame 420 is rigidly mounted at the second end 424 to the mounting plate 430. For example, the second end 424 of the frame may be bolted, glued, soldered, or otherwise attached to the mounting plate 430. In example shown in FIG. 2, the frame 420 has a fixed height. In such a case, the robotic arm 35 is configured to deposit a bagged hard drive 520, i.e., encased in a static-shielding bag 530, and to pick up an unbagged hard drive 520 at the fixed height of the frame 420. In other examples, the frame 420 may have an adjustable height. In such a case, if the height at which the robotic arm 35 is fixed, the frame 420 can be adjusted to assume a height so as cooperate with the robotic arm 35.

The de-bagging nest assembly 440 and cutting assembly 450, described in further detail herein, are mounted to the mounting plate 430, as further shown in FIG. 2. The bag gripper 460 is moveably mounted to the de-bagging nest assembly 440.

The de-bagging nest assembly 440 may include a de-bagging nest 500, also referred to as a cutting nest. The de-bagging nest 500 is rotatably mounted to the mounting plate 430 via a rotary actuator 505. In some instances, the rotary actuator 505 may be a pneumatic actuator. In some other instances, the rotary actuator 505 may be an electrical or hydraulic actuator or other such devices capable of controlling movements. As described herein, the rotation of the de-bagging nest 500 may assist in the removal of static-shielding bags from the compartment 510, after the hard drive has been removed.

Figure 3B:
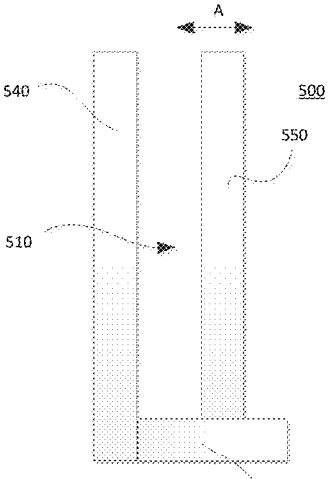
FIGS. 3B and 3C are schematic illustrations of a compartment of the de-bagging nest assembly of FIG. 3A.
Figure 3C:
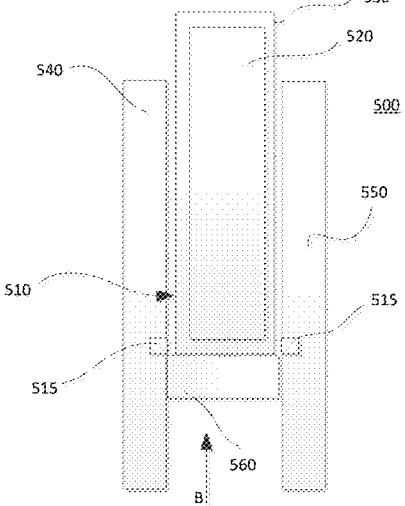
Figure 3A:
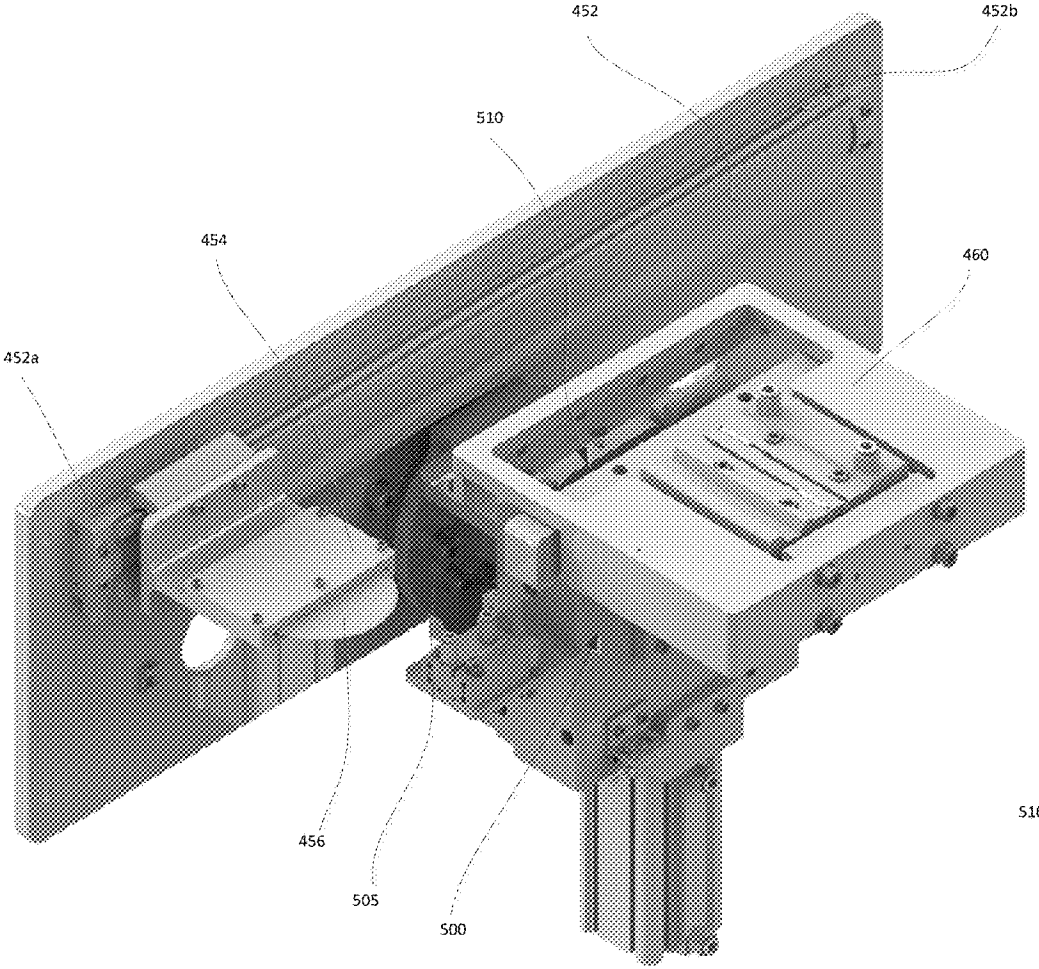
FIG. 3A is a detailed view of a de-bagging nest assembly mounted to a mounting plate of the system of FIG. 1.

Referring now to FIGS. 3A-3C, the de-bagging nest 500 includes a compartment 510. The compartment 510 may be sized to receive a bagged item, for example a hard drive 520 encased in static-shielding bag 530, as shown in FIG. 3C. The compartment 510 may be sized such that the hard drive 520 is completely accommodated within the compartment. In one configuration, the compartment 510 has first and second side-walls 540, 550 and a movable bottom 560.

Figure 3D:
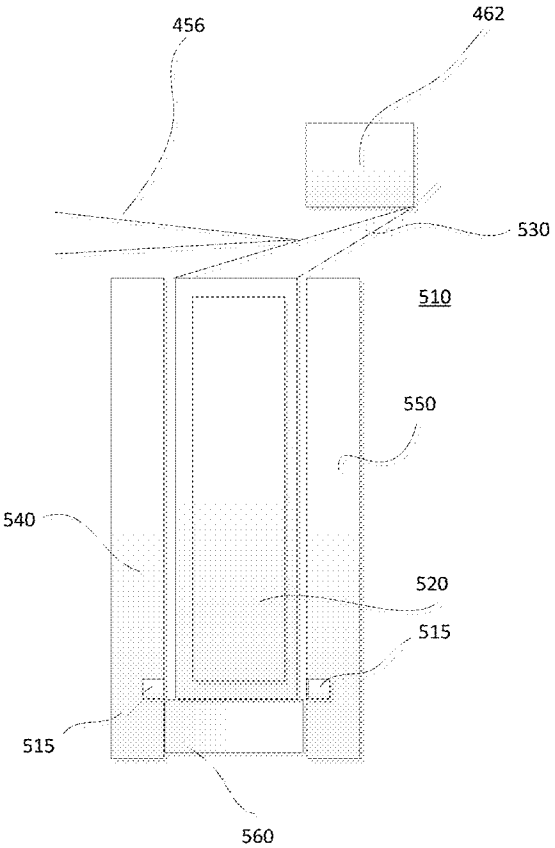
FIG. 3D is a schematic illustration of the compartment of FIG. 3B along with partial sections of a cutting mechanism and a bag gripper.

The movable bottom 560 may move up or down relative to the side-walls 540, 550 to receive the hard drive 520 into the compartment and to eject the hard drive out of the compartment 510, as illustrated by an arrow B in FIG. 3C. In this regard, the size of the compartment 510 may be adjusted by moving the movable bottom 560 up and down relative to the side-walls 540, 550. The movable bottom 560 can assume at least two terminal positions. In the first terminal position, the movable bottom 560 is at a position relative to the side walls 540, 550 such that the hard drive 520 rests on the movable bottom such that a top portion of the hard drive protrudes beyond the upper edges of the side walls 540, 550, as shown in FIG. 3C. In the second terminal position, the movable bottom is at a position relative to the side walls 540, 550 such that the hard drive 520 is received completely within the compartment 510, as shown in FIG. 3D. In the second terminal position, shown in FIG. 3D, no part of the hard drive 520 may protrude beyond the upper edges of the side walls 540, 550.

While in the examples above the compartment 510 includes a movable bottom, in other examples the bottom 560 of the compartment may not be movable. In such a case, the compartment 510 may be sized such that grippers of the robotic arm 35 may enter the compartment 510 to pick up the hard drive 520 or the grippers of the robotic arm 35 may be configured to grab the hard drive 520 from the exposed end.

In one configuration, one or both of the first and second side-walls 540, 550 may be movable. In a first position, the movable one of the side-walls 540, 550 is arranged at a sufficient distance from the other side-wall such that the bagged hard drive 520 may be easily received in the compartment, without any resistance or hindrance caused by the side-walls 540,550, as seen in FIG. 3C.

In a second position illustrated in FIG. 3B, the movable one of the side-walls 540, 550 is moved towards the other side-wall so as to exert a predetermined amount of pressure on the bagged hard drive 520. In this regard, the hard drive 520 is held within the compartment 510 under a predetermined pressure exerted by the side-walls 540, 550 and/or the movable bottom 560, such that when the bag gripper 460 grips a top portion of the static-shielding bag 530, as described herein, the hard drive 520 is not inadvertently pulled out of the compartment. Although not shown, the compartment 510 may include additional side-walls to form an enclosure along with the movable bottom 560, to surround the entirety of the hard drive with the exception of one side. Although FIG. 3B shows side-wall 550 moving towards side-wall 540, in some instances side-wall 540 may move towards side-wall 550 or both side-walls may move towards each other.

The movement of the side-walls 540, 550 and/or base may be controlled by one or more drive units, such as servo motors, actuators including pneumatic actuators, screw and belt driven actuators, or other such devices capable of controlling movements.

Referring to FIG. 3A, a bag gripper 460 is moveably mounted to the de-bagging nest assembly 440. The bag gripper 460 may take form of a generally rectangular frame. The bag gripper 460 rests above the side-walls 540, 550 of the compartment 510. The bag gripper is configured to move laterally relative to the side-walls from a first position into at least a second position. In the first position partially seen in FIG. 3A, a first side-wall 462 of the bag gripper 460 is aligned with the first side-wall 540 of the compartment 510. In the second position, shown in FIG. 5D, the first side-wall 462 of the bag gripper 460 is aligned with or has moved beyond the second side-wall 550 of the compartment 510. When a bagged hard drive 520 is inserted into and completely received within the compartment 510, a top portion of the static-shielding bag 530 protrudes beyond the upper edges of the side-walls 540, 550. When the bag gripper 460 is moved from the first position to assume the second position, the bag gripper 460 grips the top portion of the static-shielding bag 530 extending beyond the compartment 510 between the upper edge of the side wall 550 and the first side-wall 462. In some instances, the bag gripper 460 may be attached to a guided pneumatic cylinder, which in turn may be attached to the de-bagging nest assembly 440. In some other instances, other types of actuators such as hydraulic actuators or electrical actuators may also be used to move the bag gripper 460.

The de-bagging nest assembly 440 may further include a sensor set 515 for detecting the presence of at least one of the hard drive 520 and the static-shielding bag 530 in the compartment 510. In some instances, the sensor 515 may detect and verify the presence of the empty static-shielding bag 530 in the compartment 510 after the robotic arm 35 has picked up the hard drive 520, thereby ensuring that the empty bag 530 has not been inadvertently picked up the robotic arm 35. In one exemplary configuration, the sensor set 15 includes a set of four sensors. In other instances, there may be more than four or less than four sensors in the sensor set 515. By way of non-limiting example only, two of the four sensors 515 may be inductive sensors and the other two of the four sensors may be photoelectric sensors. It will be understood that other types of proximity sensors may also be used. In one example, a pair of an inductive sensor and a photoelectric sensor, may be arranged about the mid-point of the compartment 510 where a bottom of bagged hard drive 520 will rest when deposited by the robotic arm 35 into the compartment 510. In one example, another pair of an inductive sensor and a photoelectric sensor may be arranged in vicinity of the bottom 560 when the hard drive 520 is in a position in which the bag 530 may be cut open. In other implementations, the sensor set 515 may include combinations of other types of proximity sensors.

Still referring to FIG. 3A, the cutting assembly 450 includes a rail 452 mounted to the mounting plate 430. A carriage 454 is moveably attached to the rail 452. A cutting blade 456 is coupled to the carriage 454. In some instances, the cutting blade may be coupled directly to the rail 452, with the carriage 454. The carriage 454 is configured to move along the rail 452 from a first end 452*a* of the rail 452 to a second end 452*b* of the rail 452. In this regard, the carriage 454 may include wheels or bearings which enable it to slide along the rail 452. Drive units, such as servo motors, actuators including screw and belt driven actuators, or other such devices capable of controlling movements may be used to move the carriage 454 and cutting blade 456 along the rail 452.

As the carriage 454 moves the cutting blade 456 slides over the upper edges of the side walls 540, 550 of the compartment 510. The cutting blade 456 is configured to cut through the static-shielding bag 530 held between the compartment 510 and the bag gripper 460, as shown in FIG. 3D. In one example, the cutting blade 456 may be a ceramic blade. In another example, the cutting blade 456 may be a steel blade. In some instances, the cutting blade 456 may be sharpened on one side. In some instances, the cutting blade 456 may be sharpened on both sides. In some instances, the cutting blade 456 may be circular. In some instances, the cutting blade 456 may be semi-circular. In some instances, the cutting blade 456 may have other geometric shapes such as oval, or triangular or polyhedral. In one example, the thickness of the cutting blade 456 may be in the range of about 0.01 inches to about 0.07 inches. In other instances, the thickness of the cutting blade 456 may be varied, depending on the material of the bag 530, for example.

Figure 4:
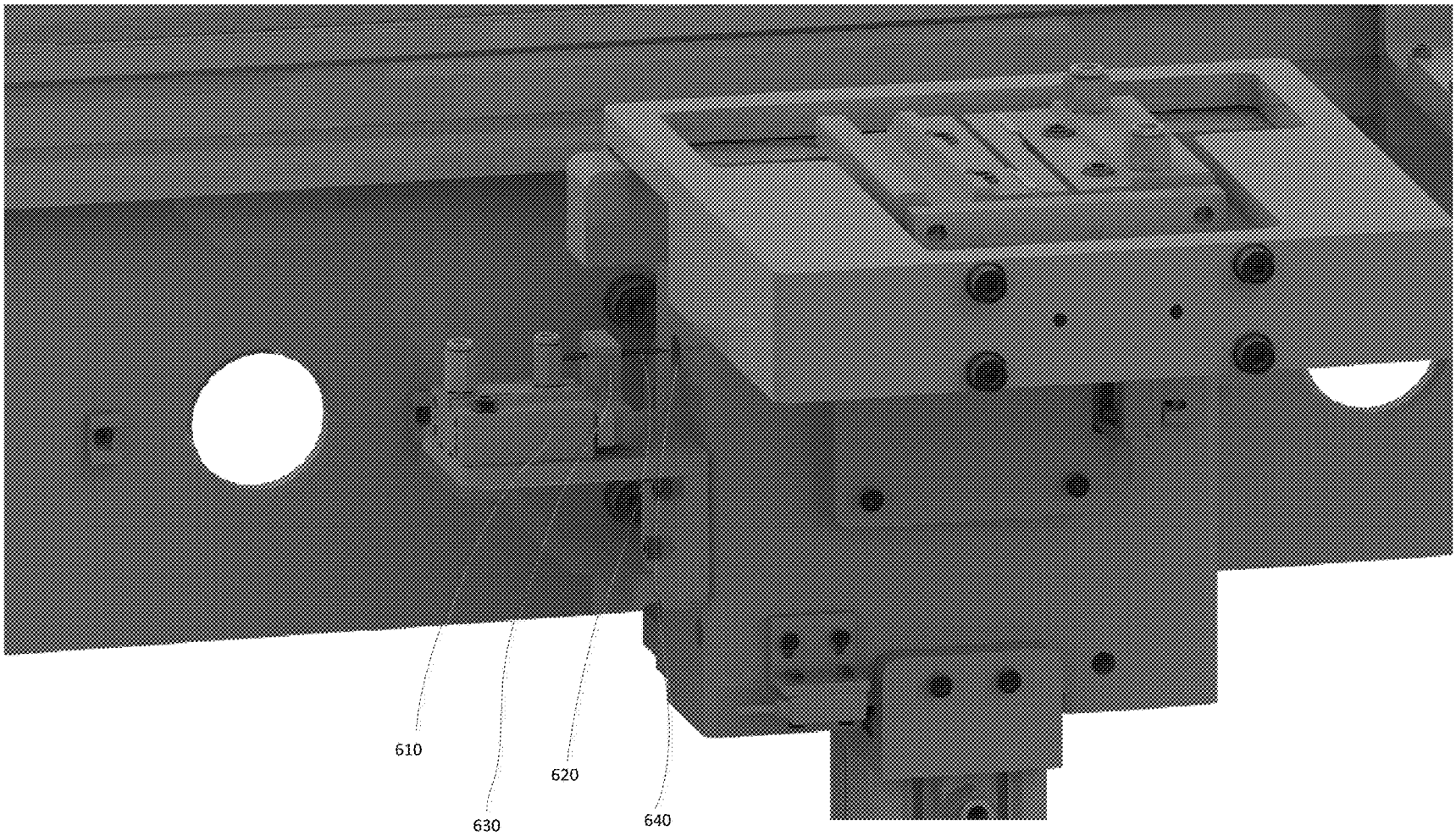
FIG. 4 is an example of a puncture mechanism of the system of FIG. 1.

Referring now to FIG. 4, the de-bagging nest assembly 440 includes an actuator 610 with a piercing element 620 to puncture the static-shielding bag 530. In one configuration, the hard drive 520 has four holes configured to receive screws or like fasteners for mounting the hard drive 520 in a mounting bracket. The actuator 610 is configured to pierce the static-shielding bag 530 with the piercing element 620 such that the piercing element 620 is received in one of the screw holes inside the compartment 510. An advantage of piercing the static-shielding bag 530 is that if the bag is vacuum-sealed about the hard drive 520, air may be introduced into the bag through the piercing and help distance the static-shielding bag 530 from the hard drive 520. In one configuration, the number of piercing elements may correspond to the number of screw holes in the hard drive.

The piercing element 620 is positioned on a movable mount 630 and the actuator 610 is configured to selectively drive the movable mount 630. The movable mount 630 is configured to move closer to and away from the compartment 510. The actuator 610 may include one or more drive units, such as servo motors, actuators including screw and belt driven actuators, or other such devices capable of controlling movements of the moveable mount 630. The compartment 510 includes an aperture 640 through which the piercing element 620 may enter the compartment 510 and pierce through the static-shielding bag 530 accommodated in the compartment.

Referring now to FIGS. 5A-5J, various stages of the operation of the de-bagging sub-system 40 will be described. While the stages are described in a given sequence for the ease of understanding, some of the stages may be optional while one or more these stages may also be performed simultaneously. In the stage illustrated in FIG. 5A, the cutting assembly 450 is positioned at a first end 452*a* of the rail 452. The bag gripper 460 is in the first position. The robot system 30 (not shown) may pick up a bagged hard drive 520 with a robotic arm 35 and insert the same in the compartment 510. The movable bottom 560 is in the first terminal position such that a top portion of the hard drive 520 protrudes beyond the upper edges of compartment 510 as well as beyond the bag gripper 460.

Figure 5A:
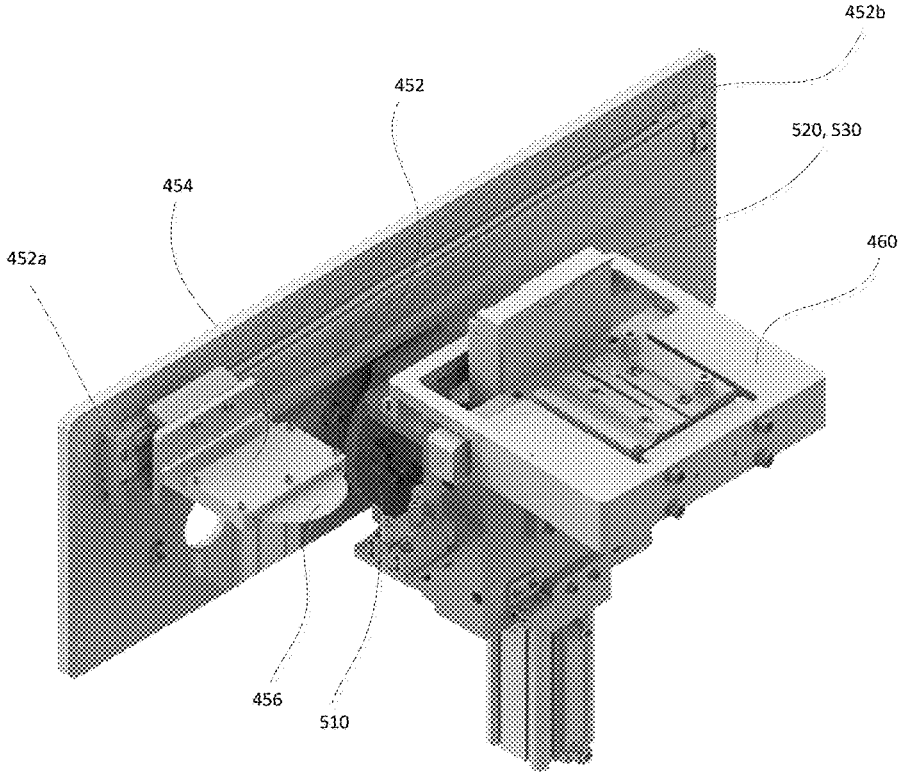
FIGS. 5A-5J illustrate various steps for removing the hard drive static-shielding bags using the system of FIG. 1.
Figure 5B:
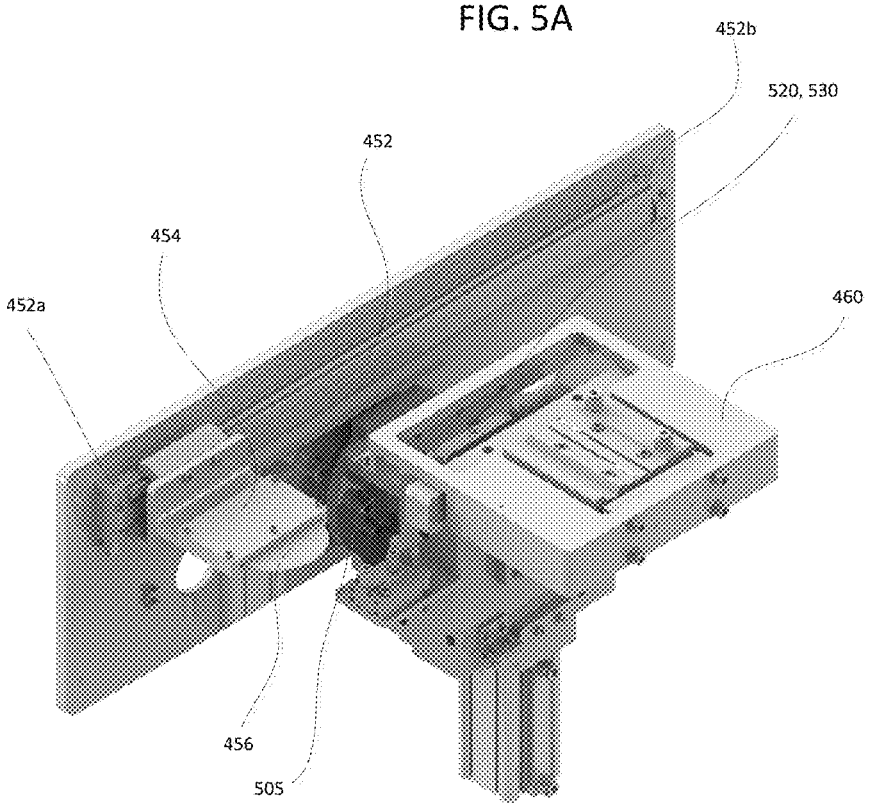
Figure 5C:
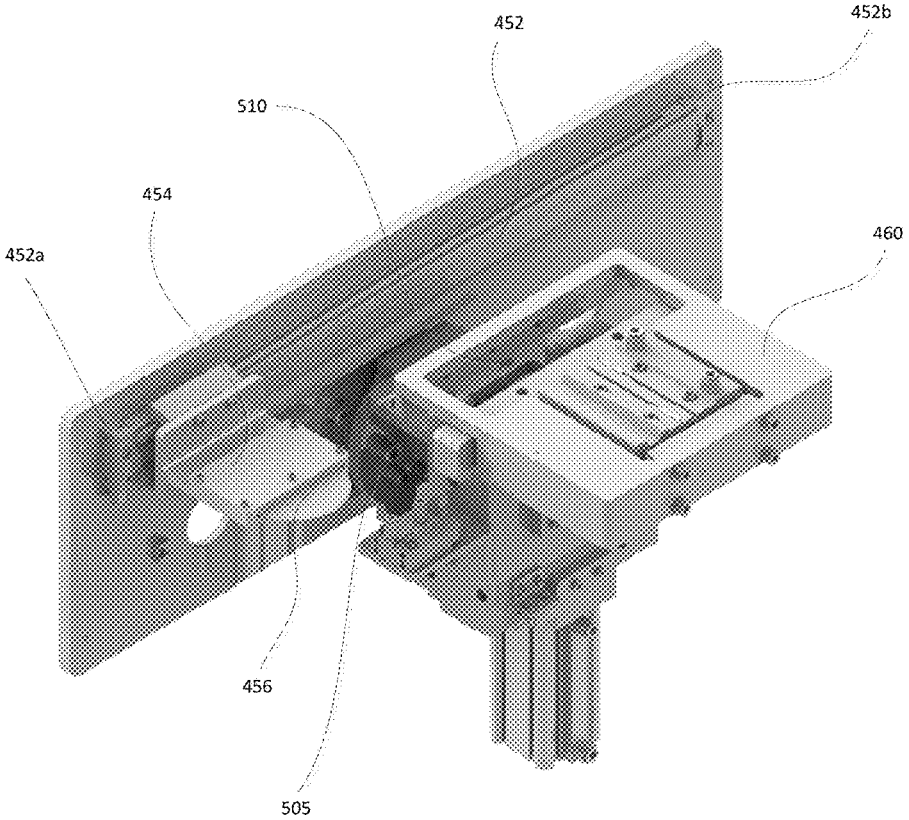

FIG. 5B illustrates a subsequent stage wherein the movable bottom 560 has moved down relative to the side walls 540, 550 (not shown) such that the hard drive 520 has been substantially received within the compartment 510. A slight portion of the hard drive 520 still protrudes beyond the upper edges of the side walls 540, 550. While not shown in the drawing, the static-shielding bag 530 protrudes beyond the upper edges of the side walls 540, 550. In some instances, the hard drive 520 may be completely received within the compartment 510, as shown in FIG. 5C.

Figure 5D:
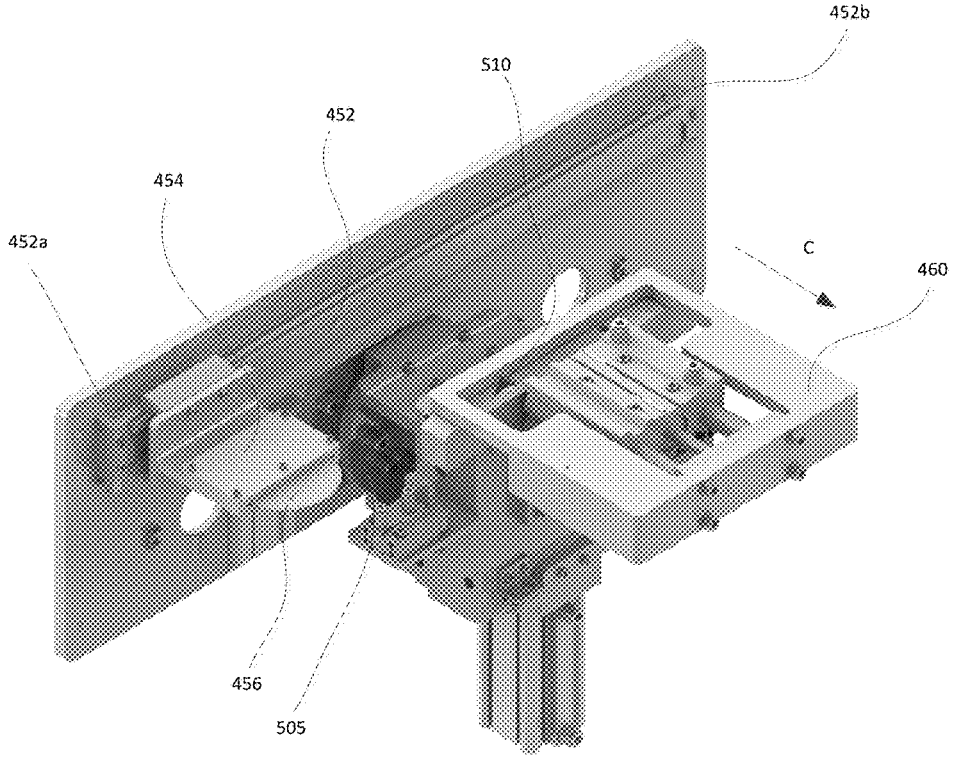

Referring now to FIG. 5D, once the hard drive 520 has been completely, or substantially, received within the compartment 510, the bag gripper 460 is moved by a drive unit, in a direction away from the mounting plate 430 and grips a top portion of the static-shielding bag 530 protruding beyond the upper edges of the compartment 510, as illustrated by an arrow C.

Figure 5E:
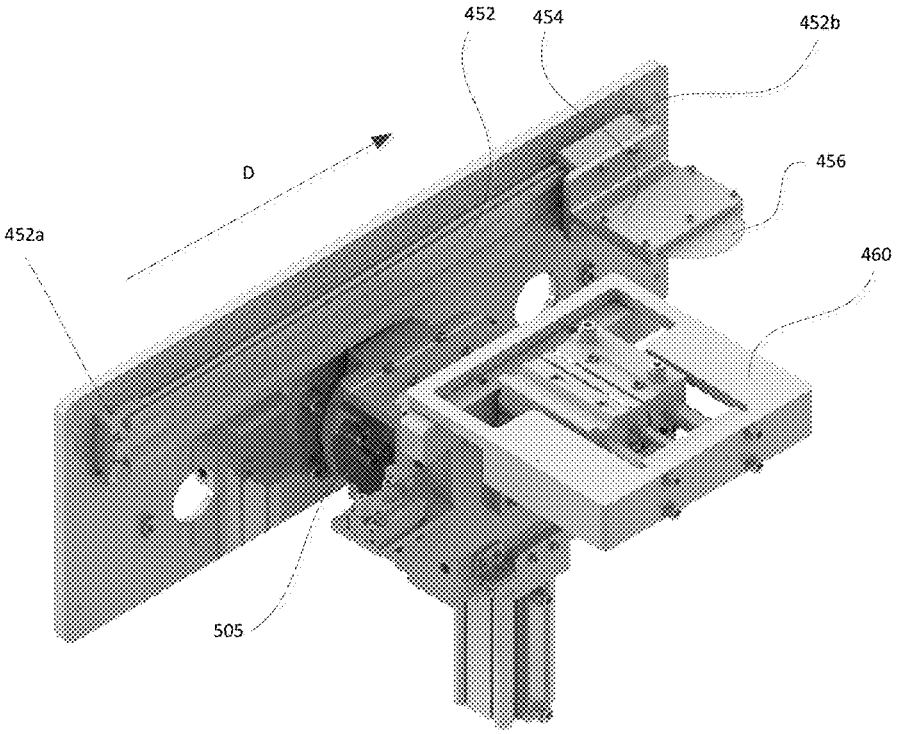

FIG. 5E illustrates a subsequent stage wherein the carriage 454 of the cutting assembly 450 is actuated, such as by a drive unit, to move along the rail 452 from the first end 452*a* to the second end 452*b*, as illustrated by an arrow D. As the carriage 454 moves along the rail 452, the cutting blade 456 cuts through the static-shielding bag 530 gripped by the bag gripper 460.

Figure 5F:
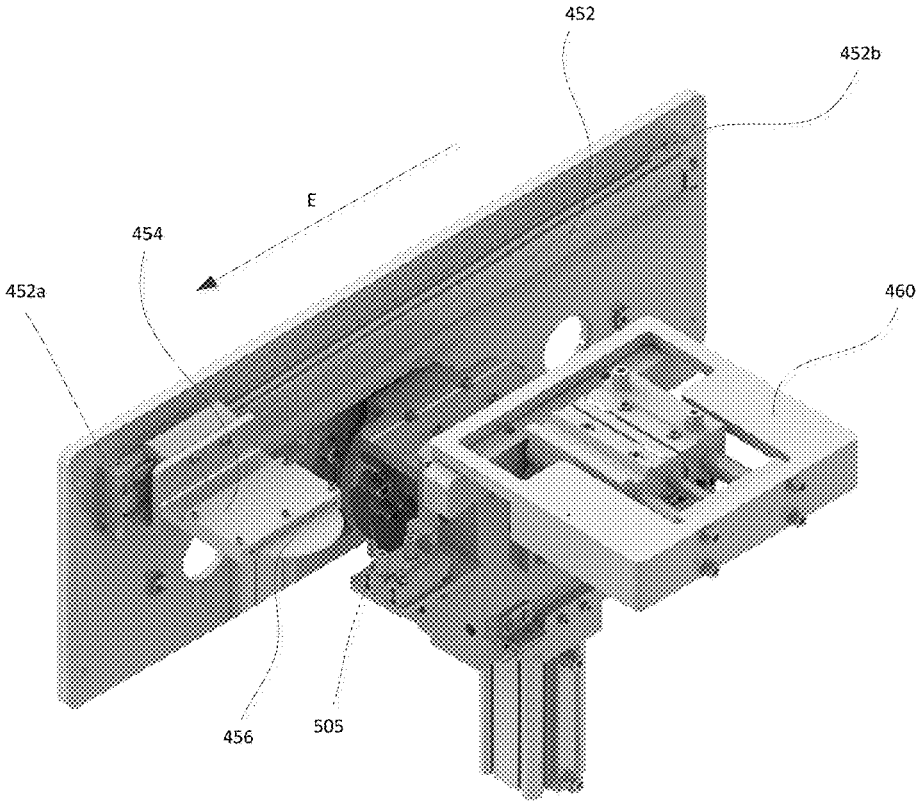

In the illustrated stage of FIG. 5F, the carriage 454 is actuated to move back from the second end 452*b* to the first end 452*a* of the rail 452, as illustrated by an arrow E. However, in other examples, this step of moving the carriage 454 back may be optional and the carriage may be left at the second end 452*b*. In such a case, the carriage 454 may return to the first end 452*a* during a subsequent cutting step.

Figure 5G:
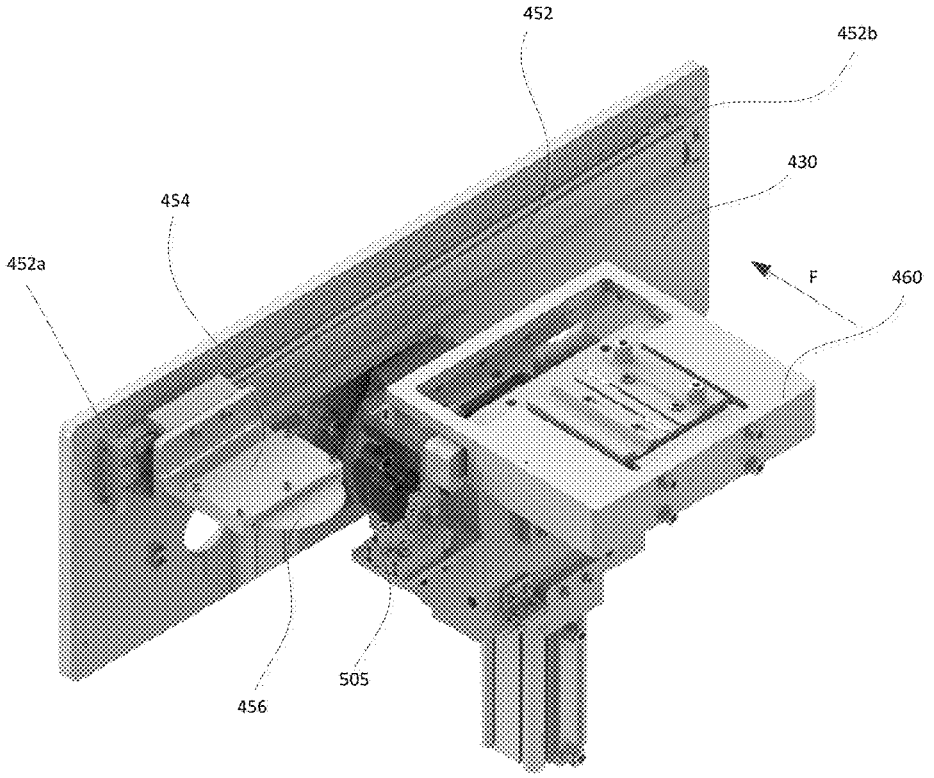

FIG. 5G illustrates yet another stage of the process wherein the bag gripper 460 is moved back in a direction toward the mounting plate 430, as illustrated by an arrow F. As the bag gripper 460 moves back, the opening of the compartment 510 is exposed.

Figure 5H:
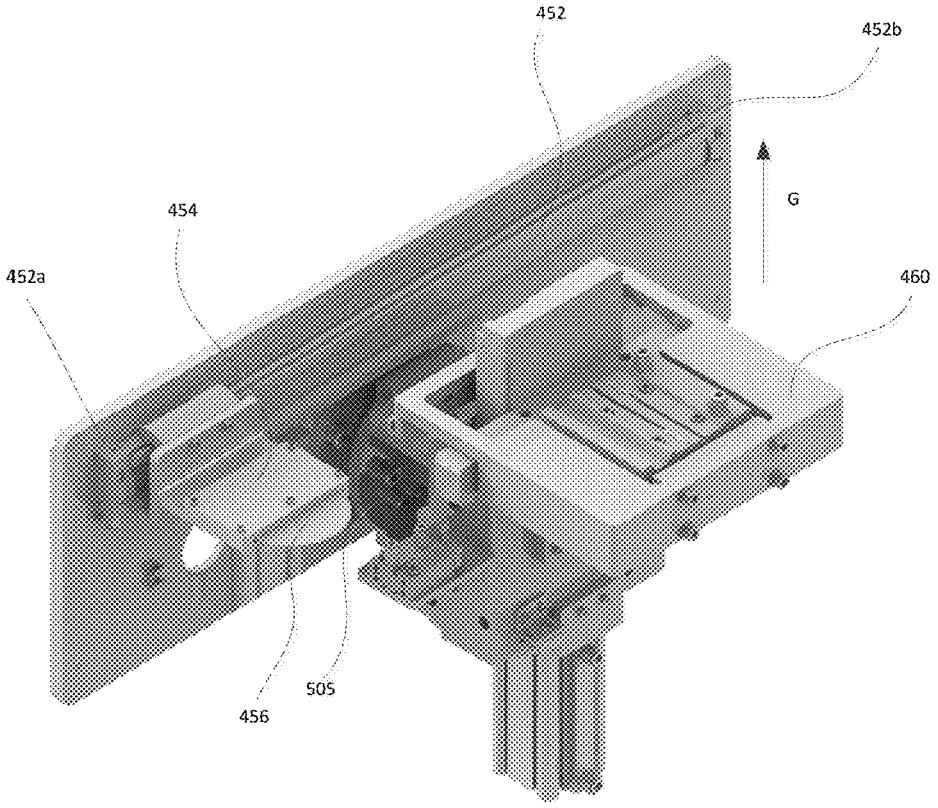

In a subsequent stage, the movable bottom 560 may be pushed upward relative to the side walls 540, 550 of the compartment 510, thereby pushing the hard drive 520 out of the compartment 510, as illustrated by an arrow G in FIG. 5H. In some instances, when the hard drive 520 is pushed out of the compartment 510, the top portion of the static-shielding bag 530 cut off by the cutting blade 456 may fall down into a trash receptacle placed under the nest assembly 400. In some instances, the top portion of the static-shielding bag 530 may remain at least partially attached to the remainder of the bag 530 on the side opposite of the cutting assembly 450.

The robotic arm 35 of the robotic system 30 may pick up the hard drive 520 from the compartment 510 and deposit the same in the hard drive receiving station 50. Alternatively, if there is no movable bottom, the robotic arm 35 may pick up the unbagged hard drive 520 directly from the compartment 510.

Figure 5I:
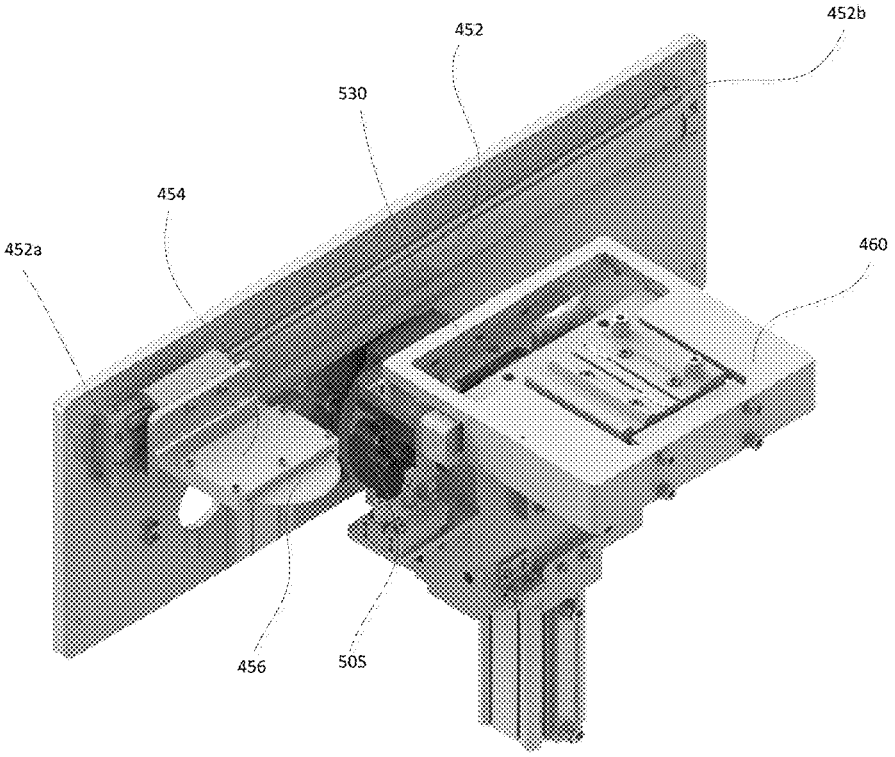
Figure 5J:
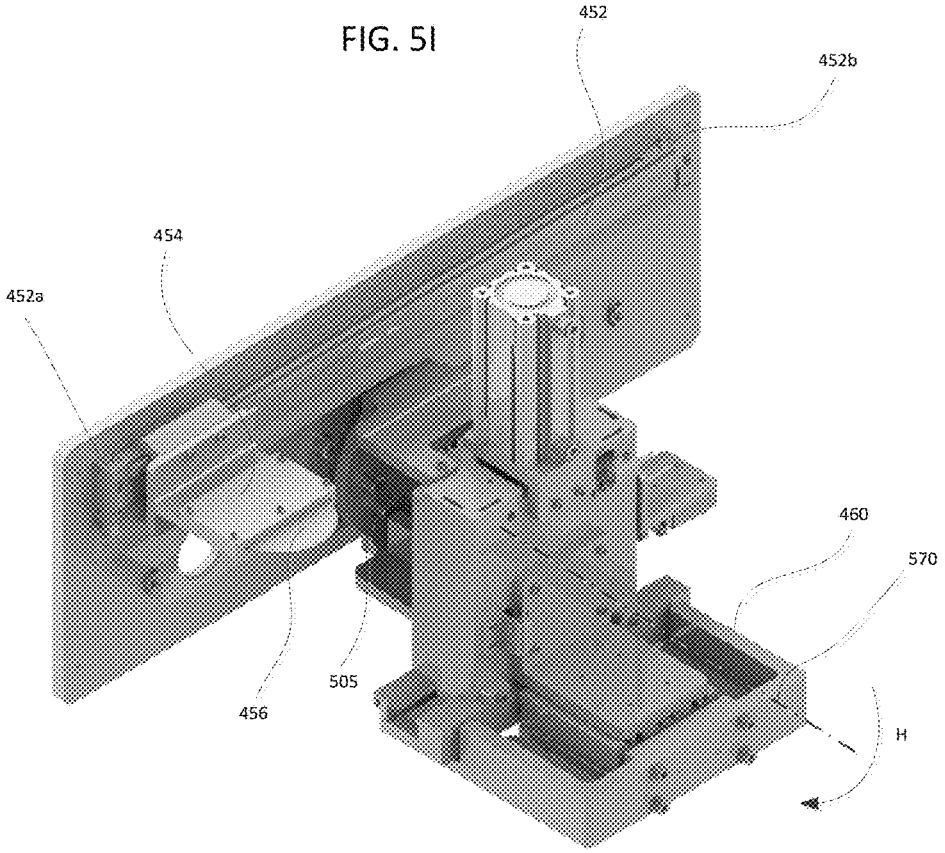
Figure 6:
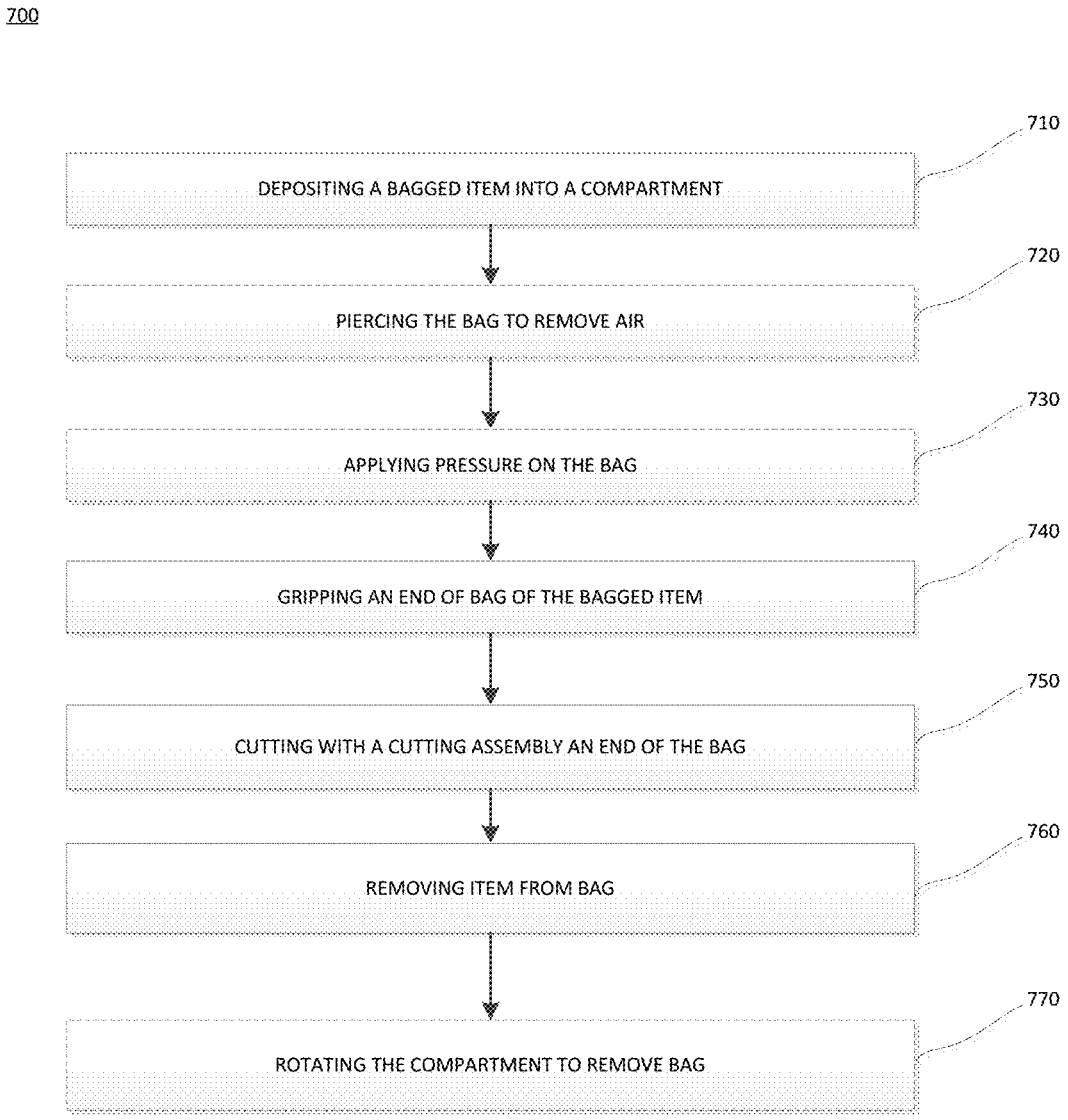
FIG. 6 is a flow chart for a method of automatically opening and removing static-shielding bags, according to an aspect of the disclosure.

Referring now to FIG. 5I, while the hard drive 520 may be removed from the compartment 510, the empty static-shielding bag 530 is left in the compartment 510. FIG. 5J shows that de-bagging nest assembly 440 rotated about an axis 570 so as to drop the empty static-shielding bag 530 from the compartment 510 into a receptacle (not shown), as shown by an arrow H. Once the static-shielding bag 520 has been removed from the compartment 510, the nest assembly 440 may be rotated about the axis 570 back to its original position shown in FIG. 5A and be ready to receive another bagged hard drive 520. In some instances a fluid, such as air may be forced into the compartment to force the static shielding bag 530 out of the compartment 510.

Another aspect of the disclosure relates to a method 700 for automatically de-bagging a hard drive encased in a static-shielding bag. The method includes a robot system or a gantry 30 picking up the bagged hard drive 520 and inserting the bagged hard drive into a de-bagging nest assembly 440, at block 710. The method further includes piercing the static-shielding bag 530 and create one or more holes through which the air within the static-shielding bag 530 may be removed, at block 720. In an optional step, pressure may be applied on the bagged hard drive 520 to remove the air from static-shielding bag 530, for example by moving the movable one of the side-wall, 540, 550, at block 730. Once the air has been removed, the bag gripper 460 may be moved to grip an end of the static-shielding bag 530 protruding from the compartment 510, at block 740. The cutting assembly 450 may then be actuated to cut the end of the static-shielding bag 530 gripped by the bag gripper 460, at block 750. A robotic arm 35 of the robot system 30 may then pick up the hard drive 520 from the open end of the static-shielding bag 530 and deposit hard drive into a hard drive receiving station 50, at block 760. The compartment 510 is then rotated to remove the static-shielding bag 530 from the compartment 510 at block 770.

The disclosed de-bagging system may be a sub-system of a fully automated component kitting/transformation line. For instance, boxes containing multiple hard drives, for example twenty (20), may be de-lidded by a robot. In one configuration, the box handling/receiving station 20 may include a conveyor belt (not shown) configured to receive and transport a box, for example, a de-lidded box full of hard drives to the desired location. The hard drives may then be removed by a robotic arm and placed onto a conveyor, de-bagging nest, or other platform.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A de-bagging system, comprising:

a robot system with a robotic arm;

a cutting nest assembly comprising a compartment, the compartment configured to receive a item encased in a bag;

a bag gripper movable relative to the compartment; and a cutting assembly comprising a cutting blade, the cutting assembly slidably mounted in vicinity of the compartment;

wherein the robot system is configured to pick up the item encased in the bag, to deposit the item encased in the bag into the compartment, and to pick up the item from the compartment.

2. The de-bagging system of claim 1, further comprising a frame.

3. The de-bagging system of claim 2, further comprising a base attached to a first end of the frame and configured to support the frame.

4. The de-bagging system of claim 2, further comprising a mounting plate mounted to a second end of the frame.

5. The de-bagging system of claim 4, wherein the mounting plate comprises a rail mounted thereon, wherein the cutting assembly comprises a carriage, the cutting blade mounted to the carriage, and wherein the carriage is slidably mounted to the rail.

6. The de-bagging system of claim 4, wherein the cutting nest assembly is rotatably mounted to the mounting plate.

7. The de-bagging system of claim 6, wherein the bag gripper is movably mounted on the cutting nest assembly.

8. The de-bagging system of claim 1, wherein the robot system is a 6-axis robot system.

9. The de-bagging system of claim 1, further comprising a first sensor arranged in the cutting nest assembly, the first sensor configured to detect presence of the bag in the compartment.

10. The de-bagging system of claim 1, further comprising a second sensor arranged on the robotic arm, the second sensor configured to detect presence of the bag on the item.

11. The de-bagging system of claim 1, further comprising a piercing element configured to pierce the bag encasing the item.

12. The de-bagging system of claim 11, further comprising an actuator configured to selectively drive the piercing element.

13. The de-bagging system of claim 1, wherein the compartment comprises a first side-wall and a second side-wall, and wherein at least one of the first side-wall and the second side-wall is movable.

14. The de-bagging system of claim 1, wherein the compartment further comprises a movable bottom.

15. A method comprising:

depositing, using a robot system with a robotic arm, an item encased in a bag into a compartment;

gripping, using a bag gripper, an end of the bag, while the item encased in the bag is accommodated in the compartment;

cutting, using a cutting assembly movable mounted in vicinity of the compartment, an end of the bag; and removing, using the robot system, the item from the bag.

16. The method of claim 15, further comprising piercing the bag to admit air into the bag.

17. The method of claim 16, further comprising moving a side-wall of the compartment to exert pressure on the bag.

18. The method of claim 15, further comprising moving a movable bottom of the compartment to receive the item encased in the bag into the compartment.

19. The method of claim 15, further comprising moving a movable bottom of the compartment to push the item out of the compartment.

20. The method of claim 15, further comprising rotating the compartment to remove the bag.

* * * * *